US010132513B2

(12) United States Patent
Moroga et al.

(10) Patent No.: US 10,132,513 B2
(45) Date of Patent: Nov. 20, 2018

(54) ROTATOR STRUCTURE OF NANOMIST-GENERATING DEVICE

(71) Applicant: CORONA CORPORATION, Niigata (JP)

(72) Inventors: Katsumi Moroga, Niigata (JP); Yuki Sugahara, Niigata (JP)

(73) Assignee: CORONA CORPORATION, Niigata (JP)

( * ) Notice: Subject to any disclaimer, the term of this patent is extended or adjusted under 35 U.S.C. 154(b) by 142 days.

(21) Appl. No.: 15/504,258

(22) PCT Filed: Aug. 6, 2015

(86) PCT No.: PCT/JP2015/072313
§ 371 (c)(1),
(2) Date: Feb. 15, 2017

(87) PCT Pub. No.: WO2016/039050
PCT Pub. Date: Mar. 17, 2016

(65) Prior Publication Data

US 2017/0261216 A1 Sep. 14, 2017

(30) Foreign Application Priority Data

Sep. 11, 2014 (JP) ..... 2014-184765

(51) Int. Cl.
*B01F 3/04* (2006.01)
*F24F 6/16* (2006.01)
*B05B 3/02* (2006.01)

(52) U.S. Cl.
CPC ..... *F24F 6/16* (2013.01); *B01F 3/04035* (2013.01); *B05B 3/02* (2013.01); *B01F 2215/0091* (2013.01); *B01F 2215/0422* (2013.01)

(58) Field of Classification Search
CPC ..... B01F 3/04035; B01F 2215/0091; B01F 2215/0422; B05B 3/02; F24F 6/16
(Continued)

(56) References Cited

U.S. PATENT DOCUMENTS 2,766,071 A * 10/1956 Flury ..... B01F 3/04035 239/214.15
3,253,821 A * 5/1966 Jamison ..... B01F 3/04035 239/215
(Continued)

FOREIGN PATENT DOCUMENTS

CN 2265502 Y 10/1997
CN 101072618 A 11/2007
(Continued)

OTHER PUBLICATIONS

Office action issued in Chinese Application Serial No. 201580047430.1 dated Jul. 3, 2018.

*Primary Examiner* — Charles S Bushey
(74) *Attorney, Agent, or Firm* — Steven M. Greenberg; Shutts & Bowen LLP

(57) ABSTRACT

Provided is a rotator structure of a nanomist-generating device which generates a nanomist by rotating a rotator having a conical shape, wherein a lower portion of the rotator is immersed in water and mist-scattering ports are disposed in an upper portion; the device generates a nanomist by scattering the water through the ports, the water being drawn up along an inner wall surface of the rotator by rotating the rotator; and a radius at an upper end of the ports is an upper portion radius R1, a height to the upper end of the ports from a waterline L is a drawing height H, and a mean angle between a horizontal line and the inner wall surface is a side surface mean angle θ1; and the angle θ1 is
(Continued)

set within θ±5% of θ for θ satisfying a basic structure equation $-R1 \sin^3 \theta + 2 H \cos \theta \sin^2 \theta + H \cos^3 \theta = 0$.

7 Claims, 6 Drawing Sheets

(58) Field of Classification Search
USPC ..... 261/78.2, 88
See application file for complete search history.

(56) References Cited

U.S. PATENT DOCUMENTS 4,279,692 A * 7/1981 Chino ..... B01D 1/225 159/11.2
4,699,737 A * 10/1987 Engstrand ..... F24F 6/16 261/120
5,215,685 A * 6/1993 Marino ..... F24F 6/16 261/72.1
5,607,627 A * 3/1997 Berkeley ..... B01F 3/04035 261/91
2006/0163754 A1* 7/2006 Barthelson ..... F24F 6/16 261/30
2008/0111257 A1* 5/2008 Huang ..... F24F 5/0035 261/90

FOREIGN PATENT DOCUMENTS

| | | | |
|---|---|---|---|
| JP | 59-010797 | | 1/1984 |
| JP | 60-143854 | | 7/1985 |
| JP | 2003307327 | | 10/2003 |
| JP | 2006057977 | A | 3/2006 |
| JP | 2008-259774 | | 10/2008 |
| JP | 2008261609 | | 10/2008 |
| JP | 2010-012167 | | 1/2010 |
| JP | 2011050533 | A | 3/2011 |
| JP | 2011-252692 | | 12/2011 |
| JP | 2011242026 | A | 12/2011 |
| JP | 2013221733 | | 10/2013 |
| JP | 2014156968 | A | 8/2014 |
| SU | 928137 | A1 | 5/1982 |
| SU | 1320605 | A2 | 6/1987 |
| WO | 2012026120 | A1 | 3/2012 |

* cited by examiner

FIG. 5

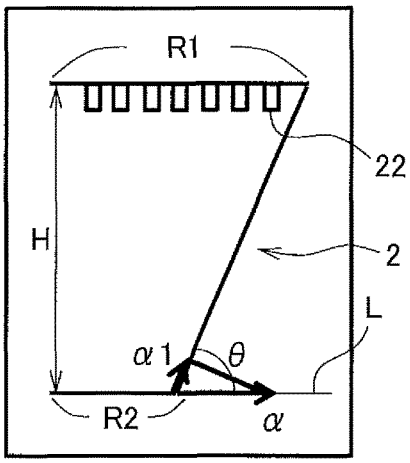

Centrifugal force acceleration $\alpha = R2\omega^2$

Wall surface rising acceleration $\alpha 1 = R2\omega^2 \cos\theta$

Wall surface rising acceleration unit $(R2\cos\theta)$

Since $R2 = R1 - \dfrac{H}{\tan\theta}$, $$R2\cos\theta = R1\cos\theta - \frac{H\cos^2\theta}{\sin\theta}$$

$f(\theta) = R1\cos\theta - \dfrac{H\cos^2\theta}{\sin\theta}$ is set.

Using extreme value condition of $f'(\theta) = 0$, $$f'(\theta) = -R1\sin\theta - \frac{H\left(-2\cos\theta\sin^2\theta - \cos^3\theta\right)}{\sin^2\theta} = 0$$

Hence, $-R1\sin^3\theta + 2H\cos\theta\sin^2\theta + H\cos^3\theta = 0$ is derived.

This is called a basic structure equation regarding a side surface mean angle θ1.

ROTATOR STRUCTURE OF NANOMIST-GENERATING DEVICE

CROSS-REFERENCE TO RELATED APPLICATIONS

This application is a Submission Under 35 U.S.C. § 371 for U.S. National Stage Patent Application of International Application Number PCT/JP2015/072313 filed Aug. 6, 2015, and entitled ROTATOR STRUCTURE OF NANOMIST-GENERATING DEVICE which is related to and claims priority to Japanese Patent Application Serial Number 2014-184765 filed Sep. 11, 2014, the entirety of both are incorporated herein by reference.

TECHNICAL FIELD

The present invention relates to a rotator structure of a nanomist-generating device, in particular, to setting of a side surface mean angle of the rotator structure of the nanomist-generating device.

BACKGROUND ART

Conventionally, there has been known a nanomist-generating device which draws up water stored in a water reservoir with use of a centrifugal force of a rotator and generates a nanomist (fine droplets of water) and/or negative ions (for example, patent documents 1, 2).

Each of nanomist-generating devices disclosed in the patent documents 1 and 2 draws up water stored in a water storing portion by rotating a conical rotator in a state of immerging of a lower portion of the conical rotator in the water storing portion to scatter the water through a plurality of fine holes, so that it generates a nanomist of fine droplets of water.

Furthermore, a nanomist-generating device disclosed in the patent documents 2 is configured to be capable of detecting a water level of water stored in the water storing portion and controlling the water level between a lower level and a higher level.

PRIOR ART DOCUMENT

Patent Document

Patent document 1: JP 2010-12167 A (refer to claim 1, paragraphs 0011 to 0018, FIGS. 2 and 3)

Patent document 2: JP 2011-252692 A (refer to claim 1, paragraphs 0009 to 0014, FIG. 1)

SUMMARY OF THE INVENTION

Problems to be Solved by the Invention

However, there has been, conventionally, no standard for judging whether an inclination angle of an inner wall surface of the rotator is optimized or not regarding a water-drawing amount of water stored in the water reservoir. Therefore, a design has been carried out by repeating making of a trial product and testing thereof in order to maximize generation amounts of a nanomist and negative ions. For this reason, there has been a problem that making of a trial product and testing thereof, which are for optimizing an inclination angle of an inner wall surface of a rotator for every product of a nanomist-generating device whose usage and/or specifications are different, have to be repeated.

On the other hand, recently, products incorporating a nanomist-generating device are diversified, and they place emphasis also on their designs in order to express their personalities, so a size of a rotator and a space also have to be considered. Therefore, it is desired that an inclination angle of an inner wall surface of a rotator is efficiently optimized, while the freedom of the design is restricted.

The present invention is created considering such a background, and it is an object of the present invention to provide a rotator structure of a nanomist-generating device which is capable of locally maximizing generation amounts of a nanomist and negative ions by setting a side surface mean angle of the rotator properly.

Means for Solving the Problem

In order to solve the problem, the invention according to claim 1 is characterized by a rotator structure of a nanomist-generating device which generates a nanomist by rotating a rotator having a conical shape an upper portion of which has a larger diameter than a lower portion thereof, wherein a lower portion of the rotator is immersed in water in a water reservoir and mist-scattering ports are disposed in an upper portion; wherein the nanomist-generating device generates a nanomist by scattering the water through the mist-scattering ports, the water being drawn up along an inner wall surface of the rotator by rotating the rotator; wherein an inner wall surface radius at an upper end height of the mist-scattering ports is an upper portion radius R1, a height up to the upper end height of the mist-scattering ports from a height of a waterline up to which the lower portion of the rotator is immersed in the water in the water reservoir is a drawing height H, and a mean angle between a horizontal line and the inner wall surface in a range of the drawing height H is a side surface mean angle θ1; and wherein the side surface mean angle θ1 is set within a range of θ+(−5% to 5% of θ) for θ satisfying a basic structure equation—$R1 \sin^3 \theta + 2 H \cos \theta \sin^2 \theta + H \cos^3 \theta = 0$.

<Derivation of Basic Structure Equation>

As shown in FIG. 5, in the nanomist-generating device of the present invention, the side surface mean angle θ1 is set according to a judgment standard of a wall surface rising acceleration α1 of water (an acceleration of water rising along the inner wall surface of the rotator) caused by a centrifugal force acceleration α due to rotation of the rotator. In the nanomist-generating device of the present invention, since water is drawn up using the centrifugal force acceleration α of the rotator, generation amounts of a nanomist and negative ions can be locally maximized by locally maximizing the wall surface rising acceleration α1 to locally maximize a water-drawing amount. The wall surface rising acceleration α1 can be calculated using an inner wall surface radius R, a wall surface angle θ, and an angular velocity ω.

$$\text{The wall surface rising acceleration } \alpha 1 = R\omega^2 \cos \theta$$

In the above equation, since factors concerning to a shape of the rotator are the inner wall surface radius R and the wall surface angle θ of the rotator, an attention is paid to a value of R cos θ (called a wall surface rising acceleration unit). That is, in order to locally maximize (to maximize) the water-drawing amount, a wall surface rising acceleration has only to be locally maximized. To do so, the wall surface rising acceleration unit has only to be locally maximized.

In the present invention, in a case where the inner wall surface radius at an upper end height of the mist-scattering ports is the upper portion radius R1, a height up to the upper end height of the mist-scattering ports from a height of a waterline up to which the lower portion of the rotator is immersed in water in the water reservoir is the drawing height H, and a mean angle between a horizontal line and the inner wall surface is the side surface mean angle θ1, a lower portion radius R2 of the inner wall surface radius at the waterline can be expressed as follows.

$$\text{Lower portion radius } R2=R1-H/\tan\theta$$

The wall surface rising acceleration unit at the height of the waterline can be expressed as follows.

$$R2\cos\theta=R1\cos\theta-H\cos^2\theta/\sin\theta$$

We express as follows.

$$f(\theta)=R1\cos\theta-H\cos^2\theta/\sin\theta$$

This equation can be regarded as one variable function of θ in a case where the upper portion radius R1 and the drawing height H are known from another point of view such as designability or design specifications.

Note that, the wall surface rising acceleration unit is derived using the lower portion radius R2 at the height of the waterline as a matter of convenience to make a concept easy. However, the wall surface rising acceleration unit can be derived also using the inner wall surface radius at a prescribed height, but not the height of the waterline.

In order to calculate the local maximum value of θ, f'(θ)=0 is set.

$$\text{Since } f'(\theta)=-R1\sin\theta-H(-2\cos\theta\sin^2\theta+\cos^3\theta)/\sin^2\theta,$$

$$-R1\sin^3\theta+2H\cos\theta\sin^2\theta+H\cos^3\theta=0$$

This equation is called the basic structure equation on the wall surface angle.

Thus, since the basic structure equation for determining a standard value of the side surface mean angle θ is derived, in the rotator structure of a nanomist-generating device of the present invention, the side surface mean angle which locally maximizes the water-drawing amount can be properly set, so that generation amounts of a nanomist and negative ions can be certainly locally maximized.

The invention according to claim 2 of the present invention is the rotator structure of a nanomist-generating device according to claim 1, wherein the side surface mean angle θ1 is set to an angle between the horizontal line and a straight line connecting a lower inner wall surface point and an upper inner wall surface point, the lower inner wall surface point being an intersection of the waterline and the inner wall surface, and the upper inner wall surface point being an inner wall surface point at the upper end height.

In the present invention, the side surface mean angle θ1 can be set to be an angle between the horizontal line and a straight line connecting the lower inner wall surface point and the upper inner wall surface point.

The invention according to claim 3 of the present invention is the rotator structure of a nanomist-generating device according to claim 1 or claim 2, wherein the side surface mean angle θ1 is set to 50 degrees≤θ<80 degrees.

In the present invention, the most suitable side surface mean angle θ1 is 75.7 degrees, which angle θ1 is derived from the basic structure equation in a case where, for example, the upper portion radius R1 is 33 mm and the drawing height H is 61 mm. This also agrees with experimental results, so this is a standard set in a proper range of the side surface mean angle θ1.

The invention according to claim 4 of the present invention is the rotator structure of a nanomist-generating device according to claim 1, wherein the inner wall surface has a tapered shape extending linearly in a front cross sectional view.

The present invention can keep the wall surface rising acceleration near the local maximum value within a range of the drawing height by forming the rotator so as to have a tapered shape extending linearly in a front cross sectional view. Therefore, the water-drawing amount can be stably kept near the local maximum value.

The invention according to claim 5 of the present invention is the rotator structure of a nanomist-generating device according to claim 1, wherein the inner wall surface has a curved shape expanding outward in a front cross sectional view.

The present invention makes the side surface angle of the inner wall surface small in a lower portion within a range of the drawing height, and gradually larger as it goes to an upper portion by forming the rotator to have a curved shape expanding outward in a front cross sectional view. In the present invention, it has been able to be confirmed by experimental results that a generation amount of negative ions is more increased than the case of the tapered shape in the case where the rotator has a curved shape expanding outward in a front cross sectional view.

The invention according to claim 6 of the present invention is the rotator structure of a nanomist-generating device according to claim 1, wherein the height of the waterline is set to a value between a prescribed lower limit height and a prescribed upper limit height in a case where the height of the waterline is controlled to change between the lower limit height and the upper limit height.

The present invention can be applied also to a rotator structure of a nanomist-generating device of a type in which a height of the waterline fluctuates. In this case, a value between the lower limit and the upper limit can be set as a height of the waterline.

Effect of the Invention

A rotator structure of a nanomist-generating device according to the present invention is capable of locally maximizing of generation amounts of a nanomist and negative ions by setting a side surface mean angle of a rotator proper.

BRIEF DESCRIPTION OF THE DRAWINGS

FIG. 5 is a view showing a process to derive a basic structure equation on the rotator structure of the present invention;

MODE FOR CARRYING OUT THE INVENTION

A rotator structure 1A of a nanomist-generating device 10A according to a first embodiment of the present invention will be described in detail properly with reference to FIG. 1 and FIG. 2.

Figure 1:
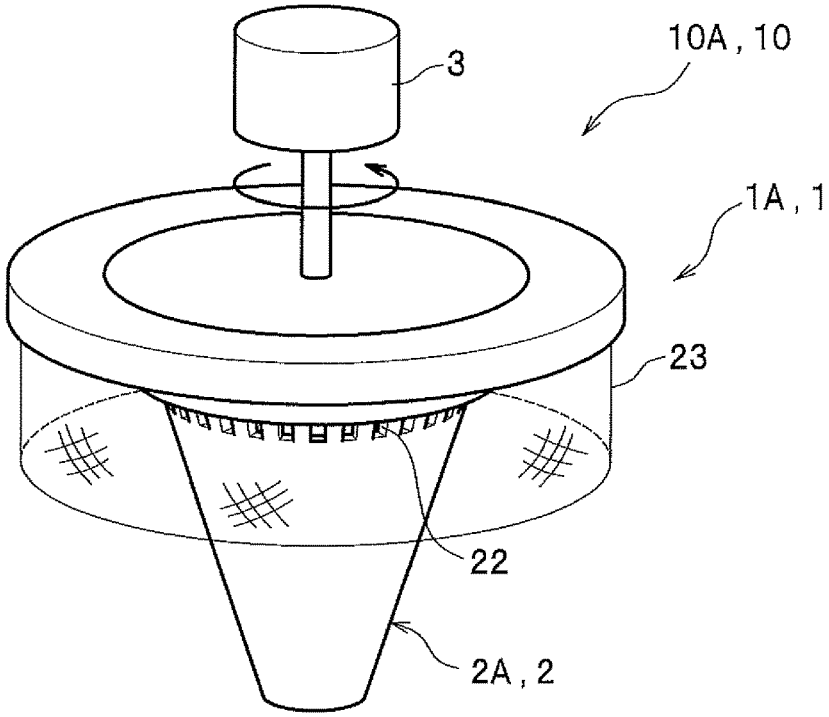
FIG. 1 is a perspective view showing an outward appearance of a rotator according to a first embodiment of the present invention.
Figure 2:
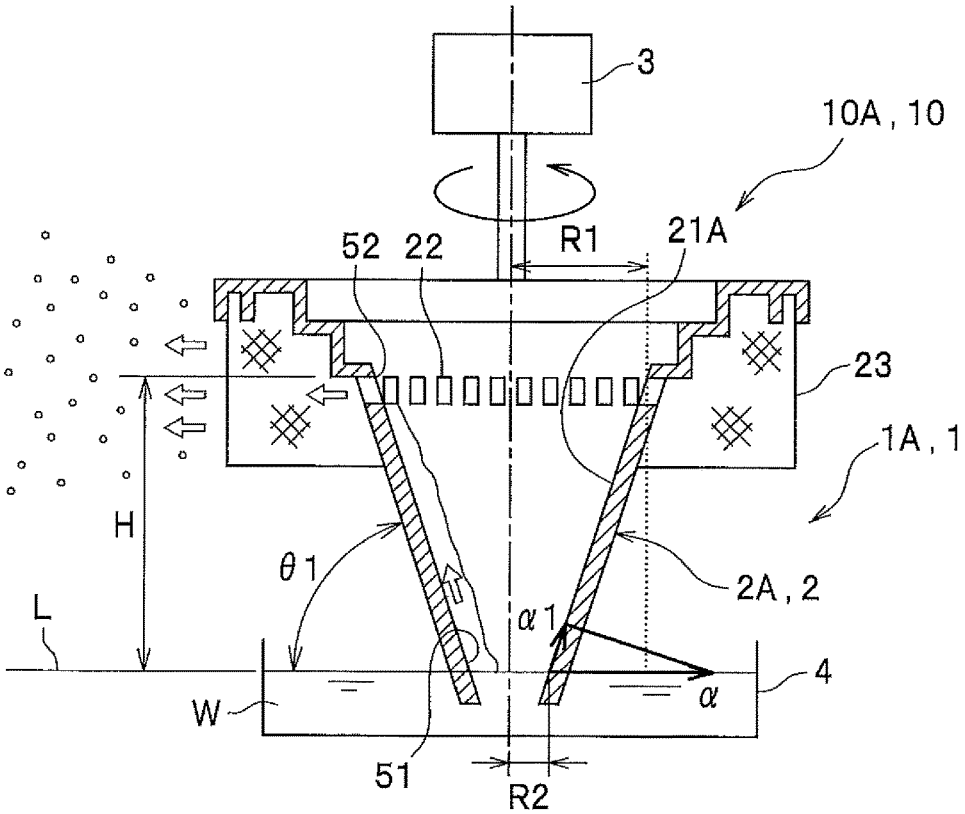
FIG. 2 is a front cross sectional view showing a structure of the rotator of a nanomist-generating device according to the first embodiment of the present invention.

As shown in FIG. 1, the nanomist-generating device 10A is equipped with a rotator 2A, a motor 3 and a water reservoir 4 (refer to FIG. 2). The rotator 2A has a conical shape such that an upper portion has a larger diameter than a lower portion. The motor 3 rotates the rotator 2A. The water reservoir 4 stores water W to be drawn up by the rotator 2A. A nanomist and negative ions are generated by rotating the rotator 2A. The nanomist-generating device 10A generates a mist of extremely fine droplets, so that a proper humidity is kept while keeping refreshment, and there are a bacteria-elimination effect and a relaxation effect due to negative ions. Therefore, the nanomist-generating device 10A is habitually used for user's health.

As shown in FIG. 2, the rotator 2A has the conical shape such that the upper portion has the larger diameter than the lower portion, and an inner wall surface 21A thereof has a tapered shape extending linearly in a front cross sectional view. A lower portion of the rotator 2A is immersed in the water W in the water reservoir 4, and the rotator 2A is provided with mist-scattering ports 22 in an upper portion thereof. A porous body 23 made with slits or made of a wire netting which promotes fining of the mist scattered from the mist-scattering ports 22 to generate negative ions, is disposed around the mist-scattering ports 22.

By adopting such a structure, in the nanomist-generating device 10A the rotator 2A is rotated to draw up the water W stored in the water reservoir 4 along the inner wall surface 21A of the rotator 2A, and scatters the water through the mist-scattering ports 22, and furthermore lets scattered droplets collide against the porous body 23 to crush them, so that a nanomist and negative ions are effectively generated.

The rotator structure 1A of the nanomist-generating device 10A according to the first embodiment of the present invention is capable of locally maximizing generation amounts of a nanomist and negative ions, because a side surface mean angle θ1 which can locally maximize a water-drawing amount can be properly set, if the side surface mean angle θ1 is set to θ+(−5% to 5% of θ) for θ satisfying the following basic structure equation:

$$-R1 \sin^3 \theta + 2H \cos \theta \sin^2 \theta + H \cos^3 \theta = 0$$

where,

R1 is an upper portion radius which is an inner wall surface radius R at an upper end height of the mist-scattering ports 22, H is a drawing height which is a height up to the upper end of the mist-scattering ports 22 from a waterline L in a state where the lower portion of the rotator is immersed in the water W in the water reservoir 4, and the side surface mean angle θ1 is an angle between the inner wall surface 21A in the range of the drawing height H and a horizontal line.

For example, the side surface mean angle θ1 can be set as follows, in a case where the upper portion radius R1 is determined by a shape of the rotator 2 to be set by a designed size of the nanomist-generating device 10, a known shape of the rotator 2 or the like, a designed drawing height H', which is a height derived by subtracting a prescribed height of the lower immersed portion of the rotator 2 necessary for drawing up the water in the water reservoir 4 from a height up to the upper end of the mist-scattering ports 22 from a lower end of the rotator 2, is determined, and the rotator 2 is disposed in the water reservoir 4 so that a lower position of the designed drawing height H' coincides with the waterline L. Note that, since the designed drawing height H' coincides with the drawing height H which is a height up to the mist-scattering ports 22 from the waterline L, the drawing height H is used instead of the designed drawing height H' hereinafter.

That is, the side surface mean angle θ is 75.7 degrees which satisfies the basic structure equation in a case where the upper portion radius R1 is set to 33 mm and the drawing height H is set to 66 mm by using a size of the nanomist-generating device 10, a known shape of the rotator 2 or the like, which R1 and H are factors in relation to a shape of the rotator 2 of the nanomist-generating device 10.

Therefore, a wall surface rising acceleration along the side surface is the local maximum value in the case of θ=75.7 degrees, that is, the angle θ of 75.7 degrees is a side surface mean angle at which a water-drawing amount becomes the local maximum. Consequently, an angle θ as a standard value of the side surface mean angle θ1 can be set to a value within about 71.9 to about 79.5 degrees.

<Side Surface Mean Angle>

Figure 3:
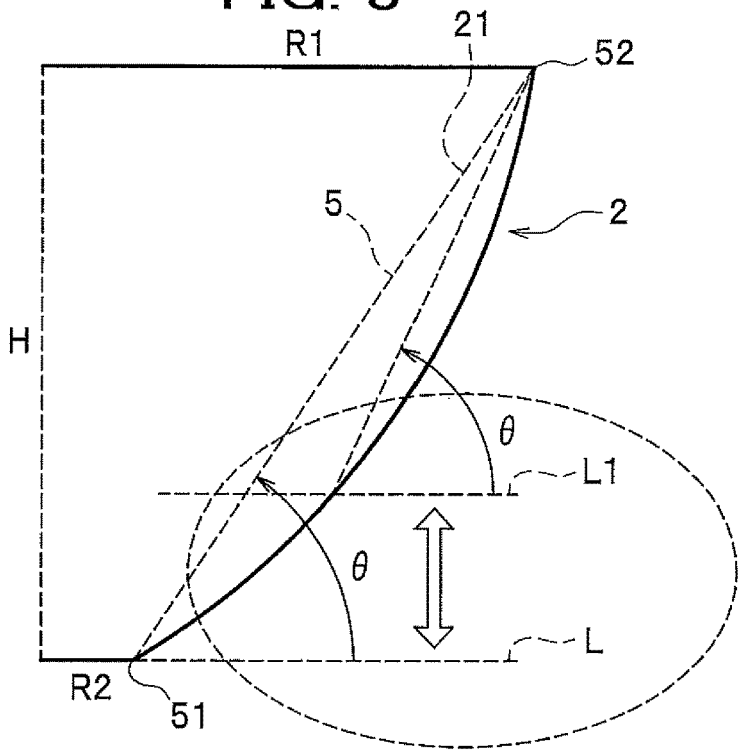
FIG. 3 is a schematic front view for explaining a waterline and a side surface mean angle of the rotator structure of the present invention.

As shown in FIG. 3, a side surface mean angle is an angle between a horizontal line (for example, waterline L) and a straight line 5 connecting a lower inner wall surface point 51 and an upper inner wall surface point 52, the lower inner wall surface point 51 being an intersection of the waterline L and the inner wall surface 21 (refer to also FIG. 2), and the upper inner wall surface point 52 being an intersection of the inner wall surface 21 and a line at the drawing height H.

Therefore, in a case of the inner wall surface 21 having a tapered shape extending linearly in the front cross sectional view, an angle θ between a horizontal line (waterline L) and the straight line 5 connecting the lower inner wall surface point 51 and the upper inner wall surface point 52 is the side surface mean angle θ=θ1.

Similarly, even if in a case of an inner wall surface 21A having a curved shape expanding outward in the front cross sectional view, an angle θ between the horizontal line (waterline L) and the straight line 5 connecting the lower inner wall surface point 51 and the upper inner wall surface point 52 is the side surface mean angle θ=θ1. Even if in a case of the inner wall surface 21 having the tapered shape or a case of the inner wall surface 21A having the curved shape, their side surface mean angles θ are the same if their lower inner wall surface points 51 are the same and their upper inner wall surface points 52 are the same.

<Waterline>

In the basic structure equation, the height of the waterline L is a height of the water W stored in the water reservoir 4. The height of the waterline L is changed as the water W is drawn up by the rotator 2. The nanomist-generating device 10 is classified into a water level fixed type (refer to FIG. 8A) and a water level changeable type (refer to FIG. 8B) according to its usage and/or specifications, the water level fixed type controlling the height of the waterline L so as to be substantially constant, and the water level changeable type controlling the height of the waterline L so as to be changeable between an upper limit water level and a lower limit water level.

Figure 8A:
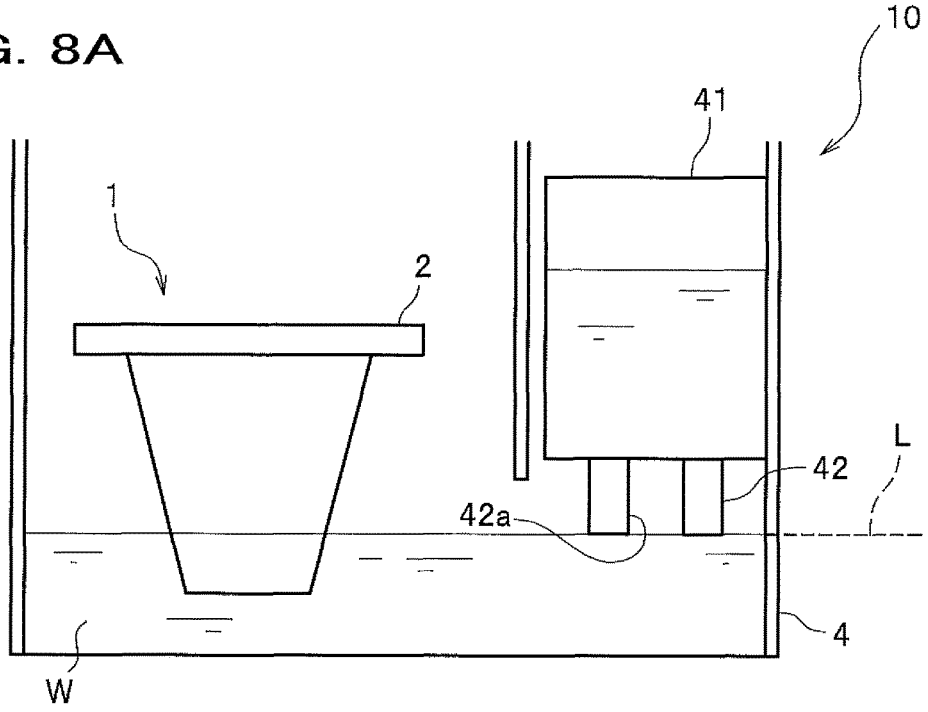
FIG. 8A is a schematic front view showing a waterline concept in the rotator structure of the present invention, which structure is a waterline-fixed type.

As shown in FIG. 8A, in the water level fixed type, water W in a water tank 41 is supplied through a supply hole 42*a* of a tank cap 42 when the water level L (height of waterline L) is lowered by drawing up the water W by the rotator 2, and when the water level L rises to an end surface of the tank cap 42 to close the supply hole 42*a*, the water supply is stopped. Thus the water level (height of waterline L) is controlled so as to be substantially constant.

In the water level fixed type, the rotator 2 is disposed in the water reservoir 4 so that the height position of the waterline L coincides with the lower end of the drawing height H which is set according to a size of the nanomist-generating device 10, a known shape of the rotator 2 or the like.

Figure 8B:
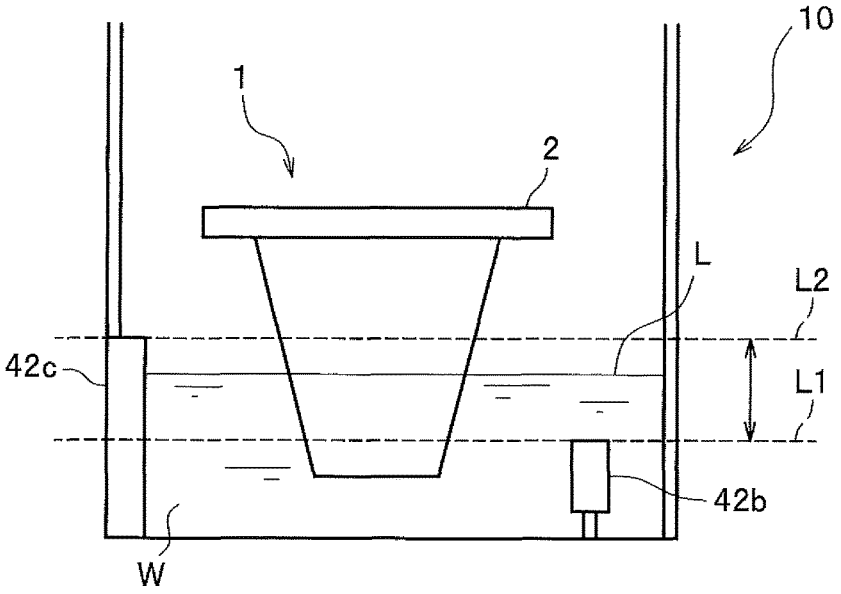
FIG. 8B is a schematic front view showing the waterline concept in the rotator structure of the present invention, which structure is a waterline-changing type.

As shown in FIG. 8B, in the water level changeable type, when the water W is drawn up by the rotator 2 and the water level L is lowered, a lower limit water level L1 is detected by a float sensor 42*b* to start supplying water into the water reservoir 4 through water supply pipe not shown, and when it is judged that the water is supplied up to an upper limit water level L2, the water supply is stopped by an upper limit water level setting device 42*c*, so that the water level (height of waterline L) is controlled between the lower limit water level L1 and the upper limit water level L2.

In the water level changeable type, the lower limit water level L1 and the upper limit water level L2 are set so that the side surface mean angle θ corresponding to a height of a variable waterline L is within a range of (θ−5% of θ) to (θ+5% of θ) for the most suitable side surface mean angle θ of the rotator 2 in a case of the designed drawing height H'. And the rotator 2 is disposed in the water reservoir 4 so that a waterline L which positions at a middle position between the lower limit water level L1 and the upper limit water level L2 coincides with the designed drawing height H'.

Furthermore, it is preferable that a difference between the lower limit water level L1 and the upper limit water level L2 is set to be small.

Figure 4:
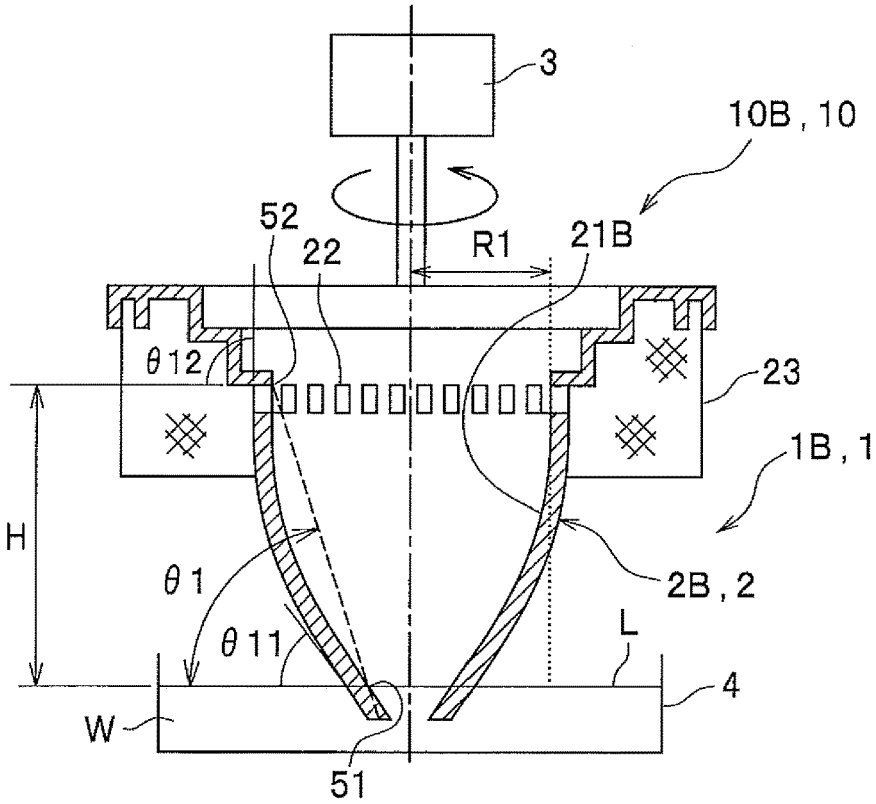
FIG. 4 is a front cross sectional view showing a structure of a rotator of a nanomist-generating device according to a second embodiment of the present invention.

Next, a rotator structure 1B of a nanomist-generating device 10B according to a second embodiment of the present invention will be explained with reference to FIG. 4.

An inner wall surface 21B of a rotator 2B according to the second embodiment has a curved shape expanding outward in a front cross sectional view. Therefore, the rotator 2B differs from the rotator 2A according to the first embodiment having the tapered shape in which the inner wall surface 21A extends linearly. However, since the other structures are similar to those of the nanomist-generating device 10A according to the first embodiment, the same symbols are used for similar structures and detailed explanations thereof are omitted.

The rotator 2B according to the second embodiment is configured so as to have the same values as the rotator 2A according to the first embodiment, as for the upper portion radius R1, the drawing height H and the side surface mean angle θ1.

The rotator 2B according to the second embodiment has a side surface angle θ11 of the inner wall surface 21B at a lower inner wall surface point 51 which the waterline L passes, and a side surface angle θ12 of the inner wall surface 21B at an upper inner wall surface point 52 which is at the uppermost height position. A side surface angle becomes gradually larger as it goes to the upper inner wall surface point 52 from the lower inner wall surface point 51 (θ11<θ12).

Operations of the rotator structures 1A, 1B (upper portion radius R1=33 mm, drawing height H=61 mm) of the nanomist-generating devices 10A, 10B according to the embodiments of the present invention constructed as above will be explained mainly with reference to experimental results shown in FIGS. 6A, 6B, 7A and 7B.

Figure 6A:
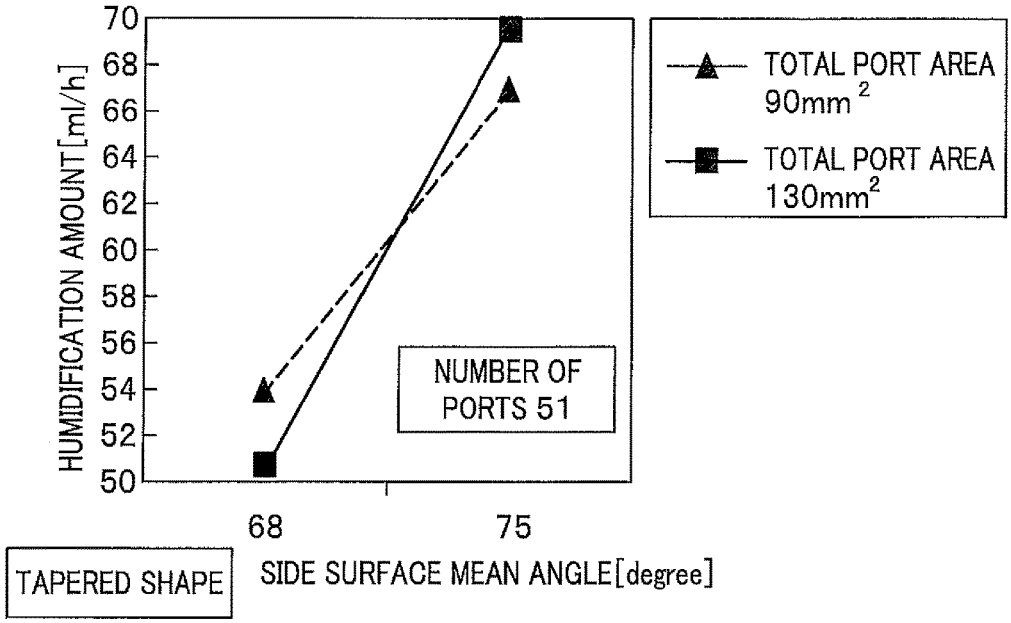
FIG. 6A is a graph showing relations between a humidification amount and a side surface mean angle of a side surface having a tapered shape of the rotator structure according to the embodiments of the present invention.
Figure 6B:
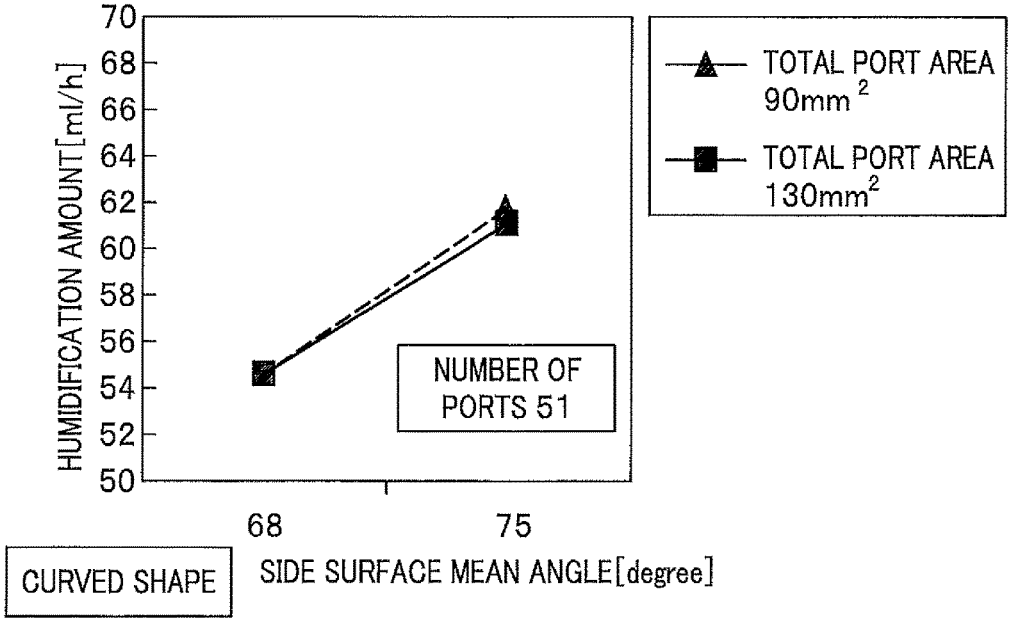
FIG. 6B is a graph showing relations between the humidification amount and the side surface mean angle of the side surface having a curved shape of the rotator structure according to the embodiments of the present invention.

FIGS. 6A and 6B to be referred to show experimental results on how shapes of rotators (rotator 2A having the tapered shape, rotator 2B having the curved shape) and side surface mean angles θ1 (68 degrees, 75 degrees) affect a humidification amount (ml/h) which has a positive correlation with a generation amount of a nanomist. FIG. 6A shows a case of the rotator 2A having the tapered shape, and FIG. 6B shows a case of the rotator 2B having the curved shape.

Furthermore, in these cases, two kinds of results of a case of the total port area of 90 $mm^2$ and a case of the total port area of 130 $mm^2$ are shown in order to examine affections of total opening area (total port area $mm^2$) of the mist-scattering ports 22.

Furthermore, experimentations are also performed in a case of the side surface mean angle θ1 of 80 degrees. However the power for drawing up the water W is insufficient, so that the generation of a nanomist was not detected. Therefore, only data for the side surface mean angles θ1 of 68 degrees and of 75 degrees are shown.

As shown in FIGS. 6A and 6B, the humidification amount (ml/h) in the case of the side surface mean angle θ1 of 75 degrees is larger than that of 68 degrees regardless of shapes of the rotator 2.

In the case of the side surface mean angle θ1 of 75 degrees, the humidification amount (ml/h) of the rotator 2A (refer to FIG. 2) having the tapered shape is 66 to 70 ml/h as shown in FIG. 6A, and on the other hand, that of the rotator 2B (refer to FIG. 4) having the curved shape is about 61 ml/h as shown in FIG. 6B. Therefore, the rotator 2A (refer to FIG. 2) having the tapered shape is superior to the rotator 2B (refer to FIG. 4) having the curved shape.

In the case of the side surface mean angle θ1 of 68 degrees, the humidification amount (ml/h) of the rotator 2A (refer to FIG. 2) having the tapered shape is 50 to 54 ml/h as shown in FIG. 6A, and on the other hand, that of the rotator 2B (refer to FIG. 4) having the curved shape is about 54 ml/h as shown in FIG. 6B. Therefore, it is understood that the rotator 2A (refer to FIG. 2) having the tapered shape is affected more largely than the rotator 2B (refer to FIG. 4) having the curved shape by the side surface mean angle and the total port area.

In the case of the side surface mean angle θ1 of 80 degrees, the generation of a nanomist was not detected due to the power shortage for drawing up the water W.

However, if a rotational speed or a rotational radius of the rotator 2 (2A, 2B) is set to be large, it is presumably recognized that the humidification amount (ml/h) has a local maximum value not at 68 nor 80 degrees but at around 75 degrees (75.7 degrees at which an extreme value is shown) of the side surface mean angle θ1. This supports that a side surface mean angle estimated by using the foresaid basic structure equation is an optimum value.

Furthermore, in a case where the side surface mean angle θ1 is too small, a size of the rotator 2 increases, so that a whole size of the nanomist-generating device 10 increases. Therefore, manufacturing of the device becomes difficult. Thus, a shape of the rotator is determined based on also the foresaid experimental result so that a range of the side surface mean angle θ1 is 50 degrees≤θ<80 degrees, preferably 68 degrees≤θ<80 degrees.

Figure 7A:
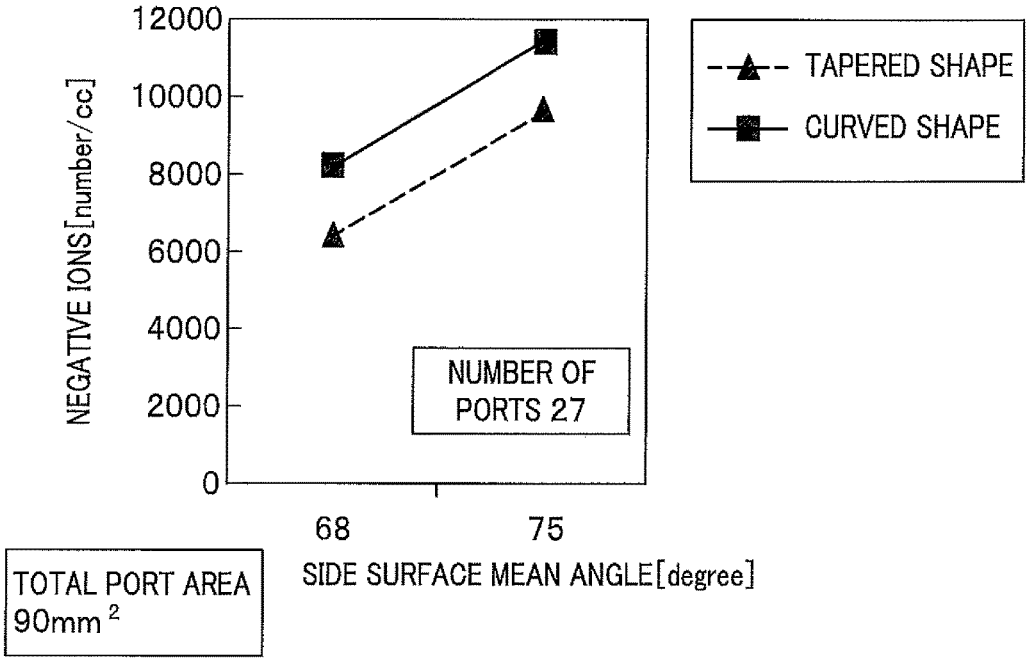
FIG. 7A is a graph showing relations between an amount of negative ions and the side surface mean angle of the side surface of the rotator structure according to the embodiments of the present invention in a case where a total area of mist-scattering ports (holes) is equal to 90 $mm^2$.
Figure 7B:
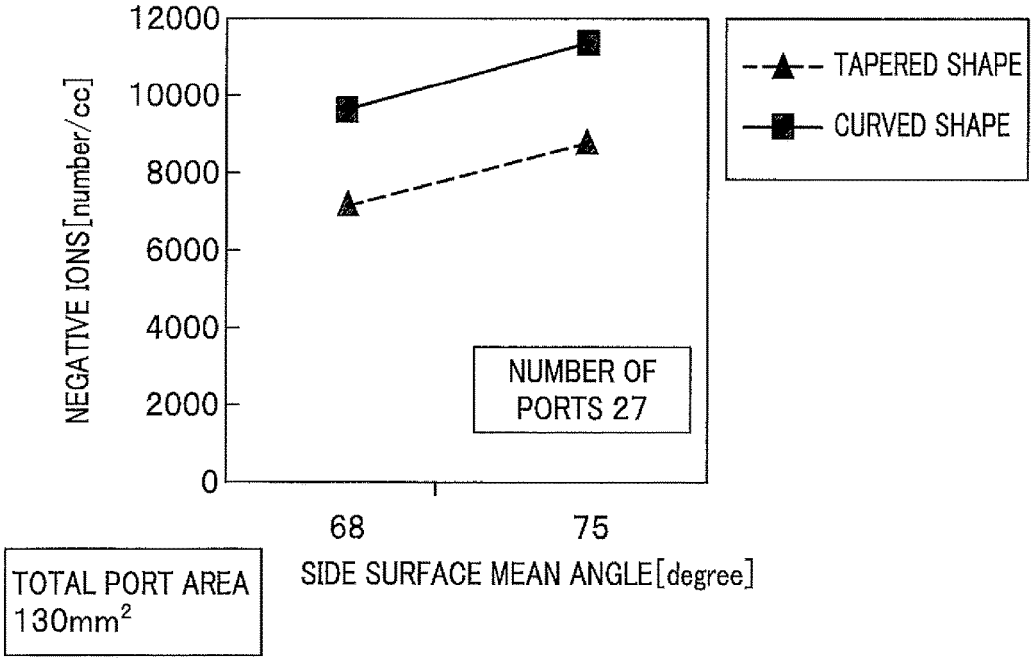
FIG. 7B is a graph showing relations between the amount of negative ions and the side surface mean angle of the side surface of the rotator structure according to the embodiments of the present invention in a case where the total area of mist-scattering ports is equal to 130 $mm^2$.

FIGS. 7A and 7B show experimental results on how shapes of rotators (rotator 2A having the tapered shape, rotator 2B having the curved shape) and side surface mean angles θ1 (68 degrees, 75 degrees, 80 degrees) affect a generation amount of negative ions (number/cc). FIG. 7A shows a case of a total port area of 90 $mm^2$, and FIG. 7B shows a case of the total port area of 130 $mm^2$.

As shown in FIGS. 7A and 7B, the generation amount of negative ions (number/cc) in the case of the side surface mean angle θ1 of 75 degrees is larger than that of 68 degrees regardless of the total port area. In a case of the side surface mean angle θ1 of 68 to 75 degrees, the rotator 2B (refer to FIG. 4) having the curved shape is superior to the rotator 2A (refer to FIG. 2) having the tapered shape. It is presumably recognized that this has been caused by increasing of a power for crushing a water droplet into fine droplets. This increasing of the power is generated as follows. That is, a pressing acceleration to perpendicularly press an inner wall surface of the rotator 2 acts profitably because of the curved shape of the rotator 2, so that the velocity of mists which are scattered through the mist-scattering ports 22 increases, and furthermore, they collide with the porous body 23 disposed around the outside of the mist-scattering ports 22 and collide with a device body wall (not shown) disposed around the outside of the porous body 23.

For the rotator 2A (refer to FIG. 2) having the tapered shape, the generation amount of negative ions is 9500 (number/cc) as shown in FIG. 7A in the case of the side surface mean angle θ1 of 75 degrees and the total port area of 90 $mm^2$, and is about 8300 (number/cc) as shown in FIG. 7B in the case of the side surface mean angle θ1 of 75 degrees and the total port area of 130 $mm^2$. Therefore, the rotator 2A (refer to FIG. 2) having the tapered shape is affected by the total port area more largely than the rotator 2B (refer to FIG. 4) having the curved shape.

Furthermore, similarly to the humidification amount (ml/h) shown in FIGS. 6A and 6B, if a rotational speed or a rotational radius of the rotator 2 (2A, 2B) is set to be large, it is presumably recognized that the generation amount of negative ions (number/cc) has a local maximum value not at 68 nor 80 degrees but at around 75 degrees (75.7 degrees at which an extreme value is shown) of the side surface mean angle θ1.

This supports that a side surface mean angle estimated by using the foresaid basic structure equation is an optimum value. Furthermore, in a case where the side surface mean angle θ1 is too small, a size of the rotator 2 increases, so that a whole size of the nanomist-generating device 10 increases. Therefore, manufacturing of the device becomes difficult. Thus, a shape of the rotator is determined based on also the experimental result so that a range of the side surface mean angle θ1 is 50 degrees≤θ<80 degrees, preferably 68 degrees≤θ<80 degrees.

According to the above, in a case where the upper portion radius R1 and the drawing height H of the rotator structure 1 (1A, 1B) of the nanomist-generating device 10 (10A, 10B) according to the embodiments of the present invention are set in response to design requests or the like, the side surface mean angle θ at which the wall surface rising acceleration is the extreme value is derived by solving a side surface mean angle θ which satisfies the basic structure equation, and thus a water-drawing amount can be locally maximized.

Therefore, if the side surface mean angle θ1 is set within a range of (θ−5% of θ) to (θ+5% of θ), the side surface mean angle θ1 at which a water-drawing amount of the water W is locally maximized can be properly set. A generation amount of negative ions and a humidification amount having a positive correlation with a generation amount of a nanomist can be locally maximized.

In the above, embodiments of the present invention have been explained, but the present invention is not limited to those and can be carried out in an embodiment appropriately modified. For example, in the embodiments, the side surface mean angle θ1 is set within a range of 75.7 degrees±5% of 75.7 degrees (about 71.9 degrees to 79.5 degrees), but it may be preferably set in the range of ±3% or appropriately also in the range of (−5% to +3%) considering influences of a friction resistance of the inner wall surface, a rotational radius, a drawing height, and so on.

DESCRIPTION OF THE SYMBOLS

1, 1A, 1B Rotator structure
2, 2A, 2B Rotator
3 Motor
4 Water reservoir
10, 10A, 10B Nanomist-generating device
21, 21A, 21B Inner wall surface
22 Mist-scattering port
23 Porous body
41 Water tank
42 Tank cap
42*a* Supply hole
42*b* Float sensor
42*c* Upper limit water level setting device
51 Lower inner wall surface point
52 Upper inner wall surface point
L Waterline
L1 Lower limit water level
L2 Upper limit water level
R Inner wall surface radius
R1 Upper portion radius
R2 Lower portion radius
W Water

The invention claimed is:

1. A rotator structure of a nanomist-generating device which generates a nanomist by rotating a rotator having a conical shape an upper portion of which has a larger diameter than a lower portion thereof, wherein a lower portion of the rotator is immersed in water in a water reservoir and mist-scattering ports are disposed in an upper portion;

wherein the nanomist-generating device generates a nanomist by scattering the water through the mist-scattering ports, the water being drawn up along an inner wall surface of the rotator by rotating the rotator;

wherein an inner wall surface radius at an upper end height of the mist-scattering ports is an upper portion radius R1, a height up to the upper end height of the mist-scattering ports from a height of a waterline up to which the lower portion of the rotator is immersed in the water in the water reservoir is a drawing height H, and a mean angle between a horizontal line and the inner wall surface in a range of the drawing height H is a side surface mean angle θ1; and wherein the side surface mean angle θ1 is set within a range of θ+(5% to 5% of θ) for θ satisfying a basic structure equation $$-R1 \sin^3 \theta + 2H \cos \theta \sin^2 \theta + H \cos^3 \theta = 0.$$

2. The rotator structure of a nanomist-generating device according to claim 1, wherein the side surface mean angle θ1 is set to an angle between the horizontal line and a straight line connecting a lower inner wall surface point and an upper inner wall surface point, the lower inner wall surface point being an intersection of the waterline and the inner wall surface, and the upper inner wall surface point being an inner wall surface point at the upper end height.

3. The rotator structure of a nanomist-generating device according to claim 1, wherein the side surface mean angle θ1 is set to 50 degrees≤θ<80 degrees.

4. The rotator structure of a nanomist-generating device according to claim 1, wherein the inner wall surface has a tapered shape extending linearly in a front cross sectional view.

5. The rotator structure of a nanomist-generating device according to claim 1, wherein the inner wall surface has a curved shape expanding outward in a front cross sectional view.

6. The rotator structure of a nanomist-generating device according to claim 1, wherein the height of the waterline is set to a value between a prescribed lower limit height and a prescribed upper limit height in a case where the height of the waterline is controlled so as to change between the lower limit height and the upper limit height.

7. The rotator structure of a nanomist-generating device according to claim 2, wherein the side surface mean angle θ1 is set to 50 degrees≤θ<80 degrees.

* * * * *